United States Patent [19]

O'Neill

[11] 4,342,486

[45] Aug. 3, 1982

[54] CUTTER BIT HOLDER

[75] Inventor: Michael L. O'Neill, Lucinda, Pa.

[73] Assignee: Joy Manufacturing Company, Pittsburgh, Pa.

[21] Appl. No.: 188,969

[22] Filed: Sep. 19, 1980

[51] Int. Cl.[3] ..... E21C 35/18

[52] U.S. Cl. ..... 299/86; 299/83; 299/88; 299/92; 37/142 A

[58] Field of Search ..... 299/86, 91–93, 299/83, 88–90; 175/379, 413; 407/55, 56; 37/142 R, 142 A

[56] References Cited

U.S. PATENT DOCUMENTS

| | | | |
|---|---|---|---|
| 1,880,091 | 9/1932 | Hughes | 299/88 X |
| 2,521,089 | 9/1950 | Phipps | 262/33 |
| 3,325,219 | 6/1967 | Guillon et al. | 299/89 |
| 3,614,164 | 10/1971 | Davis | 299/83 |
| 3,834,764 | 9/1974 | Krekeler | 299/86 |
| 4,068,897 | 1/1978 | Amoroso | 299/91 |

FOREIGN PATENT DOCUMENTS

| | | | |
|---|---|---|---|
| 3754 | of 1878 | United Kingdom | 299/88 |

*Primary Examiner*—Ernest R. Purser

*Attorney, Agent, or Firm*—Buell, Blenko, Ziesenheim & Beck

[57] ABSTRACT

A mining machine assembly includes bit supports having primary and secondary cutter bits secured thereto. The bit supports may take the form of bit holders. A drum member may have a plurality of bit holders secured thereto. At least some of the bit holders have two cutter bits secured thereto. A primary cutter bit and a secondary cutter bit are secured to such cutter bit holders. The primary and secondary cutter bits are so positioned as to travel in substantially the same orbital path upon rotation of the cutter drum. The primary cutter bit projects radially outwardly farther than the secondary bit.

20 Claims, 2 Drawing Figures

CUTTER BIT HOLDER

BACKGROUND OF THE INVENTION

1. Field of the Invention

The present invention relates to cutter bit holder assemblies for mining machines and, more specifically, relates to such holder assemblies which are adapted to hold two cutter bits.

2. Description of the Prior Art

In the operation of continuous mining machines, it has been known to provide cutter drum members to which a plurality of cutter bits are secured in such fashion that rotation of the cutter drum will cause the cutter bits to engage the bedded mineral material in order to free the same. Various mountings, spacings and cutter bit designs have been known.

It has been considered advantageous to equip the revolving drum member with fewer bits and wider spaces between bits so as to reduce the power required to sever the bedded mineral material, such as coal, as fewer bits are being driven into the mineral face and the amount of dust generated is reduced. It has also been suggested that many bits with relatively narrow spacing should be employed so that if a bit is lost or damaged the adjacent bits will be sufficiently close together that the machine will still cut satisfactorily and the uncut coal will not damage the drum or the bit holders.

U.S. Pat. No. 4,068,897 discloses a cutter drum assembly having a plurality of bit holders which are replaceable and each of which contains one cutter bit.

U.S. Pat. No. 2,521,089 discloses a mining machine cutter bit holder which is adapted to hold a unitary cutter bit having several cutter segments.

U.S. Pat. No. 3,834,764 discloses core breaker means for a mining machine wherein a pair of auxiliary core cutting members is positioned adjacent to the principal cutting means.

U.S. Pat. No. 3,614,164 discloses a receptacle for facilitating replacement of cutter bits. A pair of bit holders, which are disposed at different angular positions with respect to each other, is shown.

U.S. Pat. No. 3,325,219 discloses a cutting drum having a plurality of holders provided with two or three cutting bits which are so oriented and spaced from each other as to provide a furrow without encountering repeated depth-cutting. In connection with holders which have three picks it is stated that two of the picks have the same radial projection in order that one may serve as a replacement if the other is broken.

It has also been known to mount cutter bits on chains used to sever a bedded mineral.

There remains a very substantial need for a cutter bit assembly which provides an effective means for permitting cutter holder design and bit geometry and placement to optimize spacing of bit holders while minimizing the risk of damage to the cutter drum, holders, or chains during operation.

SUMMARY OF THE INVENTION

The present invention has met the above-identified need by providing a plurality of bit holders which are adapted to secure two cutter bits in such fashion that a primary cutter bit projects radially outwardly farther than a secondary bit and both bits are so positioned as to move in substantially the same orbital path upon rotation of the cutter drum. The primary bit may be disposed closer to the leading portion of the bit holder than the trailing bit. The radially outer surface of the bit holder may have a stepped configuration with the upper step being in communication with a bore which receives the primary cutter bit and the lower step being in communication with a bore which receives the secondary cutter bit.

It is an object of the present invention to provide a mining machine cutter drum assembly which has bit holders which secure primary cutter bits and secondary cutter bits in relative aligned relationship such that damage to or loss of the primary cutter bit will result in cutting being performed by the secondary cutter bit.

It is a further object of this invention to provide such bit holder assemblies which are adapted for use on conventional continuous mining machines.

It is a further object of the present invention to provide such bit holder assemblies and bit relationships as to permit efficient extraction of bedded minerals, while minimizing the risk of damage to the equipment and reducing downtime of the system.

These and other objects of the invention will be apparent from the following description on reference to the appended illustrations.

DESCRIPTION OF THE PREFERRED EMBODIMENTS

As used herein in the absence of an express indication to the contrary, the term "primary bit" or "primary cutter bit" shall refer to that cutter bit of a pair of cutter bits which under normal operating conditions will perform the principal or sole cutting operation.

Figure 1:
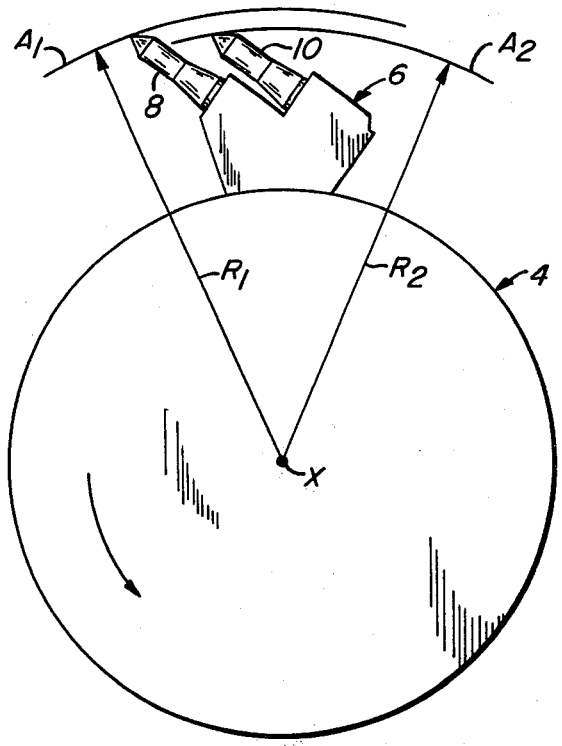
FIG. 1 is a schematic illustration of a mining machine cutter drum having a bit holder assembly of the present invention secured thereto.

Referring now in greater detail to FIG. 1, there is shown a mining machine cutter drum to which is secured a plurality of bit holders 6 (with only one being shown for clarity of illustration). The bit holder 6 has secured thereto a primary cutter bit 8 and a secondary cutter bit 10. It is noted that with respect to the central longitudinal axis X of cutter drum 4 the primary cutter bit 8 projects radially outwardly farther than secondary cutter bit 10. Arc $A_1$ is at a radius $R_1$ which is greater than the radius $R_2$ which is associated with arc $A_2$ which is the outward radial projection of secondary bit 10. In a preferred embodiment of the invention, the outward radial projection of primary cutter bit 8 from axis X is about 12 to 24 inches and exceeds the outward radial projection of secondary cutter bit 10 (or $R_1$ minus $R_2$) equals about ½ to 2 inches.

Figure 2:
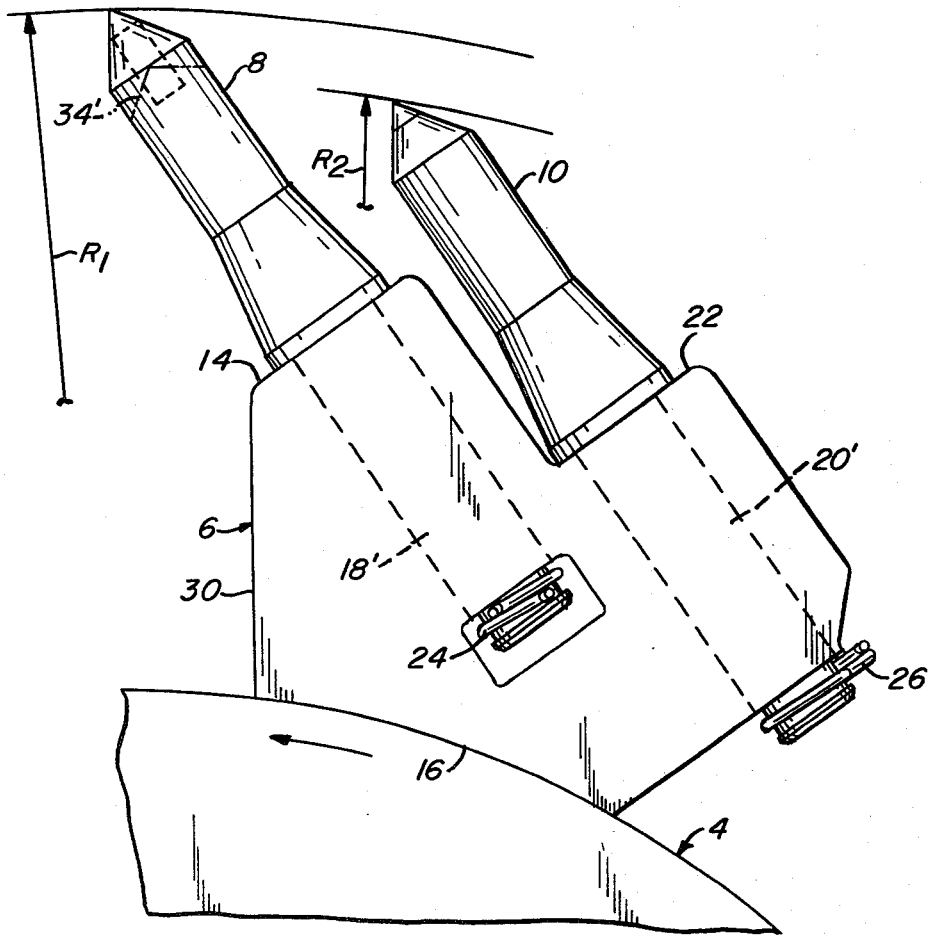
FIG. 2 is a form of bit holder assembly of the present invention shown secured to a mining machine cutter drum and having two cutter bits in place.

Referring now to FIG. 2, it is noted that the holder 6, which may be secured to the cutter drum 4 by any convenient means such as by welding, for example, has an upper surface 14 which in the form shown is stepped, a lower surface 16 and is provided with a pair of generally parallel bores 18', 20'.

In the form shown in FIG. 2, the upper surface has a stepped configuration with the upper step being in communication with bore 18' and the lower step 22 being in communication with bore 20'. The bits, in the form shown, are conical bits and are secured within the respective bores 18', 20' by locking means 24, 26, respectively, which wrap around and are received within annular recesses in their respective bits 8, 10 to provide an enlarged diameter which will resist removal of the primary bit 8 and secondary bit 10 from their respective bores 18', 20'.

Figure 3:
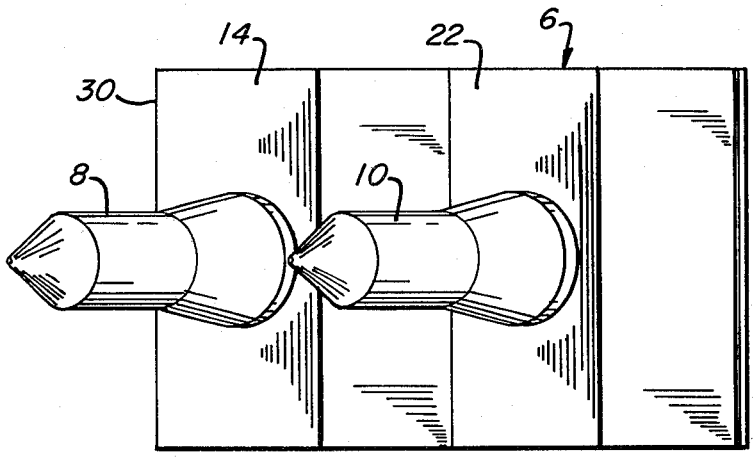
FIG. 3 is a top plan view of the bit holder assembly of FIG. 2.

It is noted that with the drum rotating in the direction shown by the arrows in FIGS. 1 and 2, the primary bit 8 will be positioned closer to the leading surface 30 of the bit holder 6 than will the secondary bit 10. As a result of the bits being aligned as is shown in FIG. 3 and having the relative projections shown in FIGS. 1 and 2, during normal operation, the primary bit 8 will serve a cutting function while the secondary bit 10 will serve a a backup function. It is preferred that the bits 8, 10 be in substantially the same orbital path upon rotation of the cutter drum. It is also preferred that the longitudinal axes of the bits 8, 10 be generally parallel. Should the primary bit 8 become broken such that its radial extent is less than $R_2$, the secondary bit 10 will assume a primary cutting role thereby continuing efficient operation of the mining machine and resisting damage to the bit holder 6 or to the drum 4.

Referring once again to FIG. 2, there is shown an indication of a worn primary bit 8 by the dotted representation designated 34'. As this worn edge 34' continues to project radially outwardly beyond radius $R_2$, it will continue to cut. At a point where it becomes worn to such an extent that it projects less than a radius $R_2$, the secondary bit 10 will assume a primary cutting function.

While in the form illustrated, both bits 8, 10 are conical bits of substantially identical size and shape, it will be appreciated that the desired coplanar rotational position combined with farther projection of the primary bit may be accomplished by using bits of different axial extent.

Figure 4:
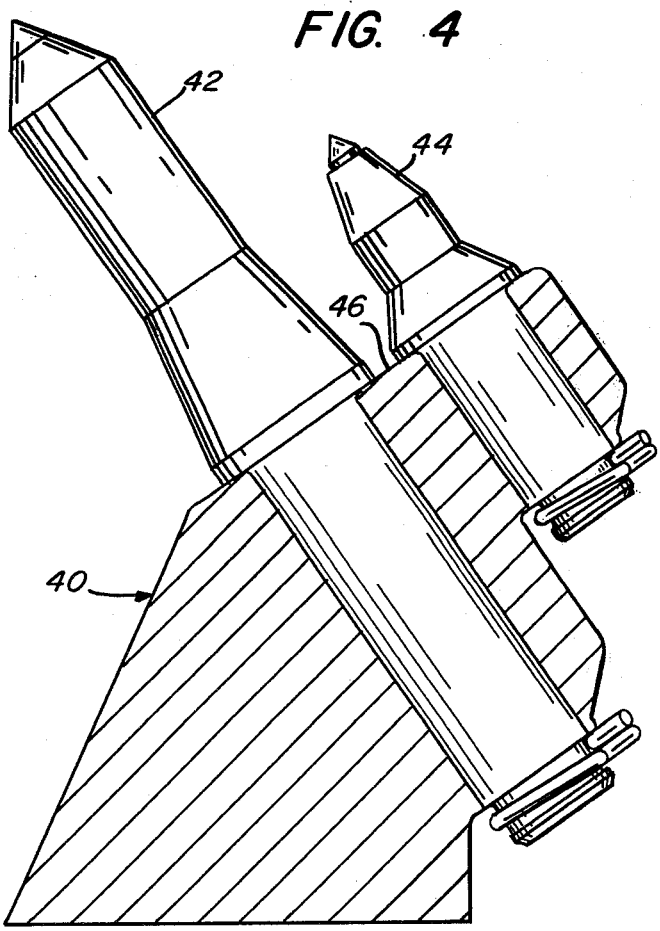
FIG. 4 is a cross-sectional illustration of a modified embodiment of the bit holder assembly of the present invention.

Referring now to FIG. 4, there is shown a modified form of the present invention wherein the bit holder 40 has a substantially planar upper surface 46 and a primary bit 42 which is of greater axial extent than the secondary bit 44 with the primary bit projecting radially beyond the radial projection of the secondary bit 44.

In a preferred embodiment of the invention, the axial bores which receive the bits will not only be substantially parallel but will preferably be spaced from each other by about 2 to 4 inches measured from axis to axis.

It will be appreciated that in the preferred embodiment of the invention the primary cutter bit projects farther outwardly than the secondary cutter bit with respect to a plane oriented generally perpendicularly with respect to the central longitudinal axis of one said bit and passing through the other said bit. Also, while in a preferred embodiment the axes of the cutter receiving bores will generally be parallel, it will be appreciated that the axes may be relatively angularly disposed while remaining in substantially the same orbital path.

While for convenience of reference herein emphasis has been placed upon specific holder configurations and the use of conical bits, it will be appreciated that other holder configurations and other types of bits may be employed so long as the geometric relationships described above are provided to establish the primary and secondary functional relationship between the cutter bits. Similarly, mountings of bits on cutter chains in the recited geometric relationships may be advantageously employed. Such constructions are contemplated by the present invention.

It will be appreciated, therefore, that the present invention has provided an effective means of providing efficient operation of a mining machine through geometric design and positioning of a uniquely configurated holder and double bit assembly combination so as to facilitate reduced breakdown inefficiency of mining, while minimizing the risk of damage to the cutter drum and holder.

Whereas particular embodiments of the present invention have been described above, for purposes of illustration it will be appreciated by those skilled in the art that numerous variations of the details may be made without departing from the invention as described in the appended claims.

I claim:

1. A mining machine assembly comprising
bit support means,
a primary cutter bit secured to said bit support means,
a secondary cutter bit secured to said bit support means,
said primary cutter bit and said secondary cutter bit so positioned as to travel in substantially the same orbital cutting path upon movement of said bit support means,
said primary cutter bit projecting outwardly farther than said secondary bit, and
said primary bit being disposed closer to the leading portion of said bit support means than to said secondary bit, whereby as between said primary cutter bit and said secondary cutter bit said primary cutter bit will do substantially all of the cutting until such time as through wear or other means said secondary cutter bit will project outwardly farther than said primary cutter bit.

2. The mining machine of claim 1 wherein
said mining machine has a drum member,
said bit support means includes a plurality of bit holders secured to said drum member, and
at least some of said bit holders having means for securing two cutter bits.

3. The mining machine assembly of claim 2 including
said primary bit having a radial projection measured from the central longitudinal axis of said cutter drum of about 12 to 24 inches.

4. The mining machine assembly of claim 3 including
said bit holder having a pair of generally parallel bores, and
one of said cutter bits secured in each said bore.

5. The mining machine assembly of claim 4 including
the distance between the longitudinal axes of said bores being about 2 to 4 inches.

6. The mining machine assembly of claim 1 including
said bits being conical bits.

7. The mining machine assembly of claim 6 including
said cutter bits being substantially identical.

8. The mining machine assembly of claim 2 including
said secondary bit being of lesser axial extent than said primary bit.

9. The mining machine assembly of claim 2 including
said bit holder having a lower surface secured to said cutter drum and an upper surface,
said upper surface having a stepped configuration, a first bore in communication with an upper step receiving a portion of said primary bit, and a second bore in communication with a lower step receiving a portion of said secondary cutter bit.

10. The mining machine assembly of claim 2 including the longitudinal central axis of said cutter bits lie substantially within the same plane which is substantially perpendicular to the longitudinal axis of said drum member.

11. A bit holder assembly comprising a bit holder, said bit holder having a pair of cutter bit securing bores, a primary cutter bit disposed within a first said bore, a secondary cutter bit disposed within a second said bore, said primary cutter bit projecting outwardly farther than said secondary cutter bit with respect to a plane oriented generally perpendicular to one said cutter bit longitudinal axis and passing through the other said cutter bit, said cutter bits being substantially aligned so as to travel in substantially the same orbital cutting path when said bit holder is secured to a mining machine cutter drum, said bit holder having a leading portion adapted to face the direction of movement of said bit holder when said bit holder is mounted on a cutter drum, and said primary bit being disposed closer to said leading portion of said bit holder than said secondary bit, whereby as between said primary cutter bit and said secondary cutter bit said primary cutter bit will do substantially all of the cutting until such time as through wear or other means said secondary cutter bit will project outwardly farther than said primary cutter bit.

12. The bit holder assembly of claim 11 including said primary bit projecting outwardly about ½ to 2 inches farther than said secondary bit.

13. The bit holder assembly of claim 11 including said cutter bit securing bores being oriented generally parallel with respect to each other.

14. The bit holder assembly of claim 11 including the distance between the longitudinal axes of said bores being about 2 to 4 inches.

15. The bit holder assembly of claim 14 including said bits being conical bits.

16. The bit holder assembly of claim 11 including said cutter bits being substantially identical.

17. The bit holder assembly of claim 11 including said secondary bit being of lesser axial extent than said primary bit.

18. The bit holder assembly of claim 11 including said bit holder having a lower surface adapted to be secured to a mining machine cutter member and an upper surface, said upper surface having a stepped configuration, a first bore in communication with an upper step receiving a portion of said primary bit, and a second bore in communication with a lower step receiving a portion of said secondary cutter bit.

19. A bit holder comprising a bit holder, said bit holder having a pair of cutter bit securing bores, said bit holder having a lower surface adapted to be secured to a mining machine cutter drum member and a stepped surface, a first bore in communication with an upper step for receiving a portion of a first cutter bit, a second bore in communication with a lower step for receiving a portion of a second cutter bit, the longitudinal axes of said bores are substantially parallel, said bit holder has a leading portion adapted to face the direction of movement of said bit holder when said bit holder is mounted on a cutter drum, and said first and second bores are generally aligned so as to move in substantially the same orbital cutting path upon rotational movement of said mining machine cutter drum member, whereby as between said primary cutter bit and said secondary cutter bit said primary cutter bit will do substantially all of the cutting until such time as through wear or other means said secondary cutter bit will project outwardly farther than said primary cutter bit.

20. The bit holder of claim 19 wherein said stepped surface is an upper surface, and said first bore is disposed adjacent to a leading portion of said holder in respect of the direction of movement of said holder during a cutting operation.

* * * * *